US005240767A

United States Patent [19]

Umezu et al.

[11] Patent Number: 5,240,767

[45] Date of Patent: Aug. 31, 1993

[54] NONWOVEN FABRICS FOR PRINTING

[75] Inventors: Norio Umezu, Fukaya; Toshiyuki Nishijima, Saitama; Sampei Kobayashi, Funabashi; Noboru Tsukahara, Fukaya; Shinichi Fukui, Sayama, all of Japan

[73] Assignee: Dynic Corporation, Kyoto, Japan

[21] Appl. No.: 652,979

[22] Filed: Feb. 8, 1991

[30] Foreign Application Priority Data

| | | | |
|---|---|---|---|
| Feb. 10, 1990 | [JP] | Japan | 2-31256 |
| Aug. 31, 1990 | [JP] | Japan | 2-231783 |
| Aug. 31, 1990 | [JP] | Japan | 2-231784 |

[51] Int. Cl.[5] ..... B05D 5/00; B05D 3/12

[52] U.S. Cl. ..... 428/283; 428/284; 428/285; 428/286; 428/287; 428/289; 428/290; 430/138; 524/195; 524/714

[58] Field of Search ..... 430/138; 428/206, 285, 428/286, 355, 283, 284, 287, 289, 290; 524/714, 195

[56] References Cited

U.S. PATENT DOCUMENTS

| | | | |
|---|---|---|---|
| 3,377,194 | 4/1968 | Smith et al. | 428/286 |
| 4,359,238 | 11/1982 | Tsubusaki et al. | 428/206 |
| 4,501,809 | 2/1985 | Hiraishi et al. | 430/138 |
| 4,803,115 | 2/1989 | Fushiki et al. | 428/285 |
| 4,943,612 | 7/1990 | Morita et al. | 524/714 |
| 5,061,546 | 10/1991 | Groshens et al. | 428/355 |

*Primary Examiner*—George F. Lesmes

*Assistant Examiner*—James D. Withers

*Attorney, Agent, or Firm*—Dann, Dorfman, Herrell and Skillman

[57] ABSTRACT

A nonwoven fabric, particularly composed by long-stock synthetic resin yarns such as polyethylene and polypropylene is provided at one or both surfaces thereof with an ink-setting layer formed by coating, drying and curing a resin composition containing some of acrylic resins, synthetic rubbers and polyester resins. The ink-setting layer is excellent in the transfer property and fixing ability to an oil ink which is ordinarily used for offset printing, and prevents the nonwoven fabric from being swelled or transformed by a petroleum high-boiling-point solvent contained in the oil ink. Preferably, a low-temperature cross-linking agent is incorporated with the resin composition of the ink-setting layer so as to complete cross-linking of the resin composition at a low temperature at which heat shrinkage or heat damage of the nonwoven fabric will not be caused, in a shortened period of time. Moreover, when 10 to 40% by weight of non-calcined clay, 1 to 15% by weight of titanium dioxide and 1 to 10% by weight of calcium carbonate or calcined clay are incorporated as fillers in the resin composition of the ink-setting layer, the ink-setting layer has improved absorbability, drying ability and fixing ability to a printing ink. A preferable construction of the nonwoven fabric has a first layer containing the low-temperature cross-linking agent and a second layer containing the specific filler ingredients.

2 Claims, No Drawings

NONWOVEN FABRICS FOR PRINTING

BACKGROUND OF THE INVENTION

1. Field of the Invention

The present invention relates to a nonwoven fabric for printing, which has good tearing strength and can provide printing finish as good as an art paper at a low cost.

2. Prior Art

Conventionally, various types of nonwoven fabrics have been known as material which could be used in many industrial fields including the civil engineering, carpet and furniture industry, and durable paper products, throwaway materials and coating fabrics. Such nonwoven fabrics are generally classified into a filament nonwoven fabric and a staple nonwoven fabric from the viewpoint of length of fibres which composes the nonwoven fabrics. The filament nonwoven fabric is composed of substantially endless filament fibres which are discharged through a spinning nozzle, whereas the staple nonwoven fabric generally comprises staple fibres of 5–100 mm in length. In respect of the tearing strength, it is preferred to use the filament nonwoven fabric, particularly a high-density filament nonwoven fabric made from synthetic resin such as polyethylene and polypropylene.

On the other hand, to guarantee excellent appearance for products made with such a nonwoven fabric, it is desired to give a high-quality printing process to the nonwoven fabric. Conventionally, for printing onto the filament nonwoven fabric made from polyethylene or polypropylene, there should be required use of expensive special ink such as synthetic-paper ink, ultraviolet-curing ink and electron-beam-curing ink.

However, use of the synthetic-paper ink will greatly impair the printing workability. While, when the UV-curing ink or electron-beam-curing ink is used, an expensive UV-ray generator or electron-beam generator must be employed for curing such ink, so that it becomes difficult to carry out the printing at a low cost. Moreover, in case of UV-curing ink, even after the ink is dried, residual reaction initiator and unreacted monomer smell unpleasantly, thereby deteriorating the working atmosphere.

The offset printing is widely known as a suitable method for attaining a low-cost and high-quality printing. However, such synthetic resin as polyethylene and polypropylene will be affected by a high-boiling-point solvent contained in the offset print ink, so that when the offset printing is carried out onto the nonwoven fabric made from polyethylene or polypropylene, the nonwoven fabric is swelled and unevenness occurs on the surface thereof. Moreover since the nonwoven fabric is originally inferior in the surface smoothness resulting in a poor ink-transfer property, that is, an ink attached to a blanket of an offset printing machine would not readily be transferred to the surface of the nonwoven fabric, the printing quality can not be improved as high as the level of the art papers. The ink-setting property of the nonwoven fabric is also poor so that when a plurality of the printed nonwoven fabric are stacked one another, the ink once transferred to the surface of the underlying nonwoven fabric could be re-transferred to the underside of the overlying one, this being known in general as a matter of set-off.

SUMMARY OF THE INVENTION

It is therefore an object of the present invention to realize high quality offset printing onto nonwoven fabrics, particularly, filament nonwoven fabrics, and to provide printing finish as excellent as the level of the art papers.

To achieve this object, according to the present invention, there is provided an nonwoven fabric for printing, at least one side of which is provided with an ink-setting layer comprising one or more resins selected from the group consisting of acrylic resins, synthetic rubbers and polyester resins.

From the viewpoint of tearing strength, it is preferred to use a filament nonwoven fabric composed of synthetic filament fibres such as polyamide, polyester, polyethylene and polypropylene. It is also preferred that the surface smoothness (which is determined by a surface roughness [Rz]) of the nonwoven fabric is 50 μm or less, particularly 30 μm or less. Though the weight of a generally known nonwoven fabric is 70 $g/m^2$ or more, in the present invention, it is preferred to use the fabric having a weight of about 50 $g/m^2$ or less.

The ink-setting layer can be obtained by drying and curing a resin composition containing one or more resins selected from the group consisting of acrylic resins, synthetic rubbers and polyester resins. As the acrylic resins, there can be mentioned acrylic esters such as methyl acrylate, ethyl acrylate, butyl acrylate and 2-ethylhexyl acrylate, methacrylic esters such as methyl methacrylate, ethyl methacylate, butyl methacrylate, lauryl methacrylate and stearyl methacrylate, and copolymers of these esters. In particular the 2-ethylhexyl acrylate-methyl methacrylate copolymer has good adhesion to the surface of nonwoven fabric, resulting in less probability that the ink-setting layer formed on the nonwoven fabric surface should be removed by the blanket. Incidentally, it is preferred that the acrylic resin is used as a composition in an emulsion state or aqueous dispersion. The polyester resins may include polyethylene terephthalate, alkyd resins, unsaturated polyester resins and maleic resins. The synthetic rubbers may include methacrylic ester-butadiene copolymers (MBR), methacrylic ester-styrene-butadiene copolymer, acrylonitrile-butadiene copolymer, styrene-butadiene copolymer, acrylonitrile-styrene-butadiene copolymer and carboxylate derivatives or alkali-reactive substituted derivatives thereof. In particular, the ink-setting layer mainly containing MBR can be a barrier layer for effectively preventing the nonwoven fabric from being damaged by the printing ink and shows a good ink-transfer property.

The solid content in these resin material is 10 to 60% by weight, preferably 15 to 45% by weight. When the ink-setting layer is formed by using one or more of these acrylic resins as main resin component, 0.1 to 5% by weight, preferably 1 to 2% by weight of trimethylolmelamine may optionally be added as a cross-linking agent for cross-linking the resin three-dimensionally. 0.1 to 0.5% by weight, preferably 0.1 to 0.2% by weight of a catalyst, e.g., an organic amine hydrochloric acid salt, may be added for promoting the cross-linking. 0.2 to 0.8% by weight of a dispersant, which may be a composition mainly containing a sodium polyacrylate homopolymer is also an optional additive. 50% by weight or less, preferably 20 to 40% by weight in total of fillers such as titanium dioxide, calcium carbonate, clay and the like, may also be added to improve the surface smoothness, ink-absorbability and fixing ability of the ink-setting layer. About 2% by weight of a moisture-retention component, such as casein, starch and the like, may additionally be incorporated to prevent occurrence of static electricity so as to increase the traveling speed on printing. Further, a mildewproofing agent comprising organic nitrogen compounds, for example, a pigment and a defoaming agent may be added upon necessity. Incorporation of the cross-linking agent and catalysts will make it possible that the ink-setting layer is formed at a lower temperature, which is therefore particularly preferable where the raw material of the nonwoven fabric to be prepared has such low heat resistance as of polyethylene or polypropylene.

The amount of the ink-setting layer formed on one surface of the ink-setting layer should be, in general, of the order of 7 g/m$^2$ or more, preferably 10 to 20 g/m$^2$, when measured as a solid component, though it may change depending on the kind of the resin component, the kind of the nonwoven fabric material and the printing method. Thus, the ink-setting layer can be effectively used as a barrier layer which prevents the nonwoven fabric from being swelled by a petroleum high-boiling solvent contained in the offset printing ink.

The ink-setting layer can easily be formed by coating an ink-setting-layer resin composition, in accordance with a known method employing a reverse roll coater or air knife coater, for example. The resin composition is then subjected to drying and cross-linking, with or without heating. When a heat cross-linking process is carried out, a special care should be paid so that the nonwoven fabric is not damaged nor shrunk by heat. For example, when an ink-setting layer mainly containing a synthetic rubbers is formed on a nonwoven fabric made from polyethylene, the heat cross-linking process should be carried out at a temperature below 120° C. by incorporation of the cross-linking agent and catalysts, otherwise, cross-linking should be completed without heating. On the other hand, since a nonwoven fabric made from polyester has a high heat resistance, it is permitted to carry out the cross-linking process at about 100° to 170° C. when the ink-setting layer mainly containing the rubber resin is formed on a polyester nonwoven fabric.

When a nonwoven fabric made from polyethylene or polypropylene which is inferior in the heat resistance is used as a printing medium, as described above, a special care should be paid to prevent the said nonwoven fabric from being damaged in the heating process during formation of the ink-setting layer. In particular, when a nonwoven fabric having a weight of 50 g/m$^2$ or less is utilized, the thickness thereof should be small so much, so that the said nonwoven fabric is very likely to be transformed or shrunk by heat treatment. To avoid this problem, the temperature of heat treatment should not exceed 100° C., more preferably not exceed 85° C. However, such a temperature will not be sufficient to complete the cross-linking reaction of the resin component of the ink-setting layer. Even if the reaction itself is possible, it will require a considerably long time, thereby greatly impairing the productivity. Therefore, so-called low temperature cross-linking agent is preferably incorporated into the ink-setting-layer composition. The low temperature cross-linking agent will be hereby defined as an agent capable of cross-linking the resin component at a temperature less than 100° C., preferably less than 85° C., in a relatively short time, for example in a few minutes, without any catalyst, or an agent capable of cross-linking the resin component at such a relatively low temperature in such a relatively short period of time, in the presence of one or more suitable catalysts.

As the low-temperature cross-linking agent, there can be mentioned epoxy-base cross-linking agents, oxazoline-base cross-linking agents and zirconium-base cross-linking agents such as a zirconium ammonium carbonate. Above all, tetrafunctional epoxy resins containing tertiary amines can completely cross-link the resin composition of the ink-setting layer in a relatively short period of time. Moreover, in the present invention, it is also possible to use trimethylol melamine, hexamethylol melamine and diethylene urea as the low-temperature cross-linking agent. However, in such a case, it is preferred to incorporate an organic amine hydrochloric acid salt as a catalyst with the cross-linking agent. In practice, the low-temperature cross-linking agent is blended preferably at a ratio of 0.1 to 5% by weight, more preferably 1 to 2% by weight to the ink-setting-layer resin composition. Too much incorporation of the low-temperature cross-linking agent would be costly without yielding a remarkable advantage, whereas too less incorporation would prolong a period of time to be required for cross-linking reaction.

As having been described herein, it is preferred to incorporate a filler such as titanium dioxide, calcium carbonate and clay, to improve the surface smoothness, ink absorbability and fixing ability of the ink-setting layer. From further experiments on the matter, the inventors have found that when non-calcined clay, titanium dioxide, calcium carbonate and/or calcined clay are blended at predetermined ratios respectively, the ink absorbability, drying ability and fixing ability of the ink-setting layer can be markedly improved, which will reduce the printing time and improve the print quality.

More particularly, the non-calcined clay is blended at a ratio of 10 to 40% by weight to the total amount of the resin composition. No particular result could be obtained by incorporation of less than 10% by weight of the non-calcined clay, while it is incorporated in an amount of more than 40% by weight, a dispersing stability of the resin composition would be lowered. Incidentally, the non-calcined clay means a clay which is not calcined, which is generally referred to as a kaolin clay. Preferably, the average particle size of the non-calcined clay to be incorporated is about 0.5 $\mu$m.

While, titanium dioxide is blended at a ratio of 1 to 15% by weight to the total amount of the resin composition. Incorporation of titanium dioxide in a ratio less than 1% does not bring a notable advantage, while when more than 15% by weight, the manufacturing cost of the ink-setting layer resin composition should be increased because titanium dioxide is very expensive, and the absorbability, drying ability and fixing ability to printing ink be deteriorated because the absorbability to the ink solvent of the ink-setting layer is decreased. A preferable example of titanium dioxide is a rutile type one having an average particle size of about 0.26 $\mu$m.

With respect to calcium carbonate and calcined clay, it is preferred to use calcined clay in a relatively large amount when well-glazed finish is required for the printing surface of the nonwoven fabric, while when mat finish is required, it is preferred to use calcium carbonate in a relatively large amount. Namely, the amount ratios/ratio of calcium carbonate and/or calcined clay should be changed in the range from 1 to 10% by weight to the total amount of the resin composition. When the blending ratio of calcium carbonate is less than 1% by weight, the ink-setting-layer obtained would have an insufficient ink-absorbability. While, when the ratio is more than 10% by weight, the solvent of the printing ink would be excessively absorbed in the ink-setting layer so that the gloss after the print process may be lost, and the print quality would be deteriorated. On the other hand, when the blending ratio of calcined clay is less than 1% by weight, no particular result could be obtained in respect to improvement of the ink-absorbability. While, incorporation of calcined clay in a ratio larger than 10% by weight would make it difficult to uniformly mix the ink-setting-layer resin composition. Incidentally, calcined clay means clay which is calcined to be a porous material, and has the same composition as that of ordinary clay.

The above-mentioned fillers are blended at a total ratio ranging from 10 to 50% by weight to the amount of the whole resin composition. When the ratio is less than 10% by weight, no particular filling effect could be obtained, while incorporation of these fillers at a total ratio exceeding 50% by weight would result in deterioration of uniform dispersion of the resin composition.

In the above-described construction, the ink-setting layer will improve the surface smoothness of nonwoven fabric and enhances the ink transfer property or ink fixing ability. The ink-setting layer will also function as a barrier layer which protects the nonwoven fabric from the printing ink, particularly, from the petroleum high-boiling solvent contained therein. A single layer formed on the surface of the nonwoven fabric may function as an ink-setting layer, as well as a barrier layer. However, a multiple layer construction is a preferable arrangement of the nonwoven fabric for printing, which has a first layer overlying the surface of the nonwoven fabric and acting in main as a barrier or protection against the printing ink and a second or top layer overlying he first layer and functioning in main to provide an improved ink-fixing property.

Both of the barrier layer and the top layer may be formed substantially in the same manner as mentioned in case of the sole ink-setting layer. However, the resin material used in the barrier layer which directly overlies the surface of the nonwoven fabric should preferably be formed by cross-linking with the above-mentioned low-temperature cross-linking agents. By using such low-temperature cross-linking agents, the resin material can be cross-linked on the nonwoven fabric surface in a shortened time without causing heat damage or heat shrinkage to the nonwoven fabric made from polyethylene or polypropylene which is inferior in the heat resistance. In particular, even when the nonwoven fabric to be processed is so light and thin that the weight thereof is 50 g/m$^2$ or less, the resin material can be cross-linked without causing any problems. Moreover, by incorporation of the low-temperature cross-linking agent, the ink-setting-layer resin composition is given an excellent resistant property to the solvent contained in the printing ink, which is advantageous for the barrier layer.

With respect to the top layer, it is required to have a high absorbability, drying-ability and fixing-ability to the printing ink, into the resin composition for the top layer should preferably be incorporated 10 to 40% by weight of non-calcined clay, 1 to 15% by weight of titanium dioxide and 1 to 10% by weight of calcium carbonate and/or calcined clay.

Accordingly, a preferred embodiment of the nonwoven fabric for printing according to the present invention comprises laminating on at least one surface of the nonwoven fabric (i) a barrier layer which is formed by cross-linking a first resin composition below 100° C. with a low-temperature cross-linking agent, the first resin composition including one or more resins selected from the group consisting of acrylic resins, synthetic rubbers and polyester resins, and (ii) a top layer comprising a second resin composition which includes one or more resins selected from the group consisting of acrylic resins, synthetic rubbers and polyester resins, and also includes 10 to 40% by weight of non-calcined clay, 1 to 15% by weight of titanium dioxide, and 1 to 10% by weight of calcium carbonate and/or calcined clay.

DETAILED DESCRIPTION OF THE EMBODIMENTS

Example 1

An ink-setting layer resin composition comprising a synthetic rubber was prepared by uniformly mixing 100 parts by weight of an aqueous mixture including the following ingredients (all parts being defined by weight throughout the specification unless otherwise specified):

| | |
|---|---|
| Dispersant mainly containing sodium polyacrylate homopolymer (ARONDISPEX T-40, produced by TOA GOSEI CHEMICAL INDUSTRY CO., LTD.), | 0.6 parts |
| Filler consisting of kaolin clay, calcium carbonate and titanium dioxide | 47.6 parts |
| Synthetic rubber (CROSSLENE 2M-45A, produced by TAKEDA CHEMICAL INDUSTRIES LTD.) and casein | 14.7 parts |
| Trimethylol melamine cross-linking agent (SUMITEX RESIN M-3, produced by SUMITOMO CHEMICAL CO., LTD.) | 1.2 parts |
| Additives consisting of a catalyst, defoaming agent, softening agent, ammonia water and antiseptic | 0.9 parts |
| Water | 35.6 parts |

Then, the ink-setting layer resin composition was coated on both sides of a polyethylene filament nonwoven fabric (Weight: 50 g/m$^2$, LUXER H2050XW, produced by ASAHI CHEMICAL INDUSTRY CO., LTD.) with an air knife coater, in a solid content of 18 g/m$^2$, then dried with warm air at 100° C. so as to prepare a nonwoven fabric for printing in accordance with the present invention.

Example 2

An aqueous dispersion high polymer polyester resin (MD1200, produced by TOYOBO CO., LTD., Solid Content: 34%) was coated on both sides of a polyethylene filament nonwoven fabric (Weight: 100 g/m$^2$, LUXER H2080XW, produced by ASAHI CHEMICAL INDUSTRY CO., LTD.) in a solid content of 8 g/m$^2$ with a bar coater around which was wound a wire of 0.5 mm diameter, then dried with warm air at 110° C. so as to form a barrier layer comprising a polyester resin.

Subsequently, a synthetic rubber composition for forming a top layer is formed by uniformly mixing 100 parts by weight of an aqueous mixture which was prepared from the following ingredients:

| | |
|---|---|
| Dispersant mainly containing sodium polyacrylate homopolymer (ARONDISPEX T-40, produced by TOA GOSEI CHEMICAL INDUSTRY CO., LTD.). | 0.2 parts |
| Filler consisting of kaolin clay, calcium carbonate and titanium dioxide | 39.7 parts |
| Synthetic rubber (CROSSLENE 2M-45A, produced by TAKEDA CHEMICAL INDUSTRIES LTD.) and casein | 16.0 parts |
| Trimethylol melamine cross-linking agent (SUMITEX RESIN M-3, produced by SUMITOMO CHEMICAL CO., LTD.) | 1.1 parts |
| Additives consisting of a catalyst, defoaming agent, softening agent, ammonia water and antiseptic | 0.7 parts |
| Water | 42.3 parts |

The synthetic rubber composition thus prepared was coated on the barrier layer formed as described above on both sides of the nonwoven fabric so that the solid content became 10 g/m$^2$, then was dried to form a top layer. As a result, another nonwoven fabric for printing was prepared in accordance with the present invention.

Example 3

An emulsion comprising 2-hexylacrylatemethylmethacrylate (589-341E, SAIDEN CHEMICAL CO., LTD. Solid Content: 40%) was coated on one side of a polyester nonwoven fabric (Weight: 50 g/m$^2$, YPA-50, produced by ASAHI CHEMICAL INDUSTRY CO., LTD.) with a bar coater around which a wire of 0.5 mm diameter so that the solid content became 10 g/m$^2$, then dried with warm air at 100° C., so as to prepare an nonwoven fabric for printing one side of which was coated with an ink-setting layer comprising an acrylic resin.

Example 4

An aqueous dispersion high polymer polyester resin (MD1200, produced by TOYOBO CO., LTD., Solid Content: 34%) was coated on both sides of the same polyester filament nonwoven fabric as used in Example 3 with a bar coater around which was wound a wire of 0.3 mm diameter so that the solid content became 6 g/m$^2$, then dried with warm air at 100° C., hereby forming a first layer comprising a polyester resin.

Subsequently, the same ink-setting-layer resin composition as prepared in Example 1 was coated on the first layer with a bar coater of 0.5 mm diameter so that the solid content became 10 g/m$^2$, then was dried with warm air at 100° C., so as to form a top layer. Thus, a nonwoven fabric for printing one side of which was laminated with the first anchor layer and the top layer was obtained.

With the nonwoven fabrics respectively obtained by Examples 1 to 4 were subjected to multi-color printing with an offset multi-color printer (ROLAND REKORD, a four-color offset printing machine). As a printing ink, an ordinary offset printing ink which contains a large amount of a high-boiling-point petroleum (kerosine type) solvent was used. The printing machine ran at a speed of 7000 sheets per hour with a standard drum, and the damping water was H solution.

For comparison, the nonwoven fabrics respectively used in Examples 1 to 3 were directly used as Comparative Examples 1 to 3 without forming any ink-setting-layer and barrier/top laminated layers thereon, which were subjected to the same offset printing as applied to the nonwoven fabrics of Examples 1 to 5. Moreover, a polyethylene nonwoven fabric for printing on the market was used as Comparative Example 4, and another nonwoven fabric for printing on the market to which a filler was added was used as Comparative Example 5. With respect to the nonwoven fabrics for printing used as Comparative Examples 4 and 5, special types of printing inks were used, namely an alkyd oil ink in Comparative Example 4 and a printing ink generally utilized for printing onto synthetic papers which includes a relatively small quantity of a solvent in Comparative Example 5. Besides, the offset printing condition to these Comparative Examples 4 and 5 was the same as in Examples 1 to 4.

The evaluation concerning the ink-fixing ability, print quality, printing speed and problems caused by the static electricity on the offset printing to these Examples 1 to 4 and Comparative Examples 1 to 5 are shown in Table 1.

TABLE 1

| | Ink-Fix Ability | Print Quality | Printing Speed | Trouble by Static Electricity |
|---|---|---|---|---|
| Example 1 | Good | Good | Good | Good |
| Example 2 | Good | Good | Good | Good |
| Example 3 | Good | Good | Good | Good |
| Example 4 | Good | Good | Good | Good |
| Com. Ex. 1 | Bad | Fair | Fair | Bad |
| Com. Ex. 2 | Bad | Fair | Fair | Bad |
| Com. Ex. 3 | Bad | Bad | Fair | Bad |
| Com. Ex. 4 | Fair | Fair | Fair | Fair |
| Com. Ex. 5 | Good | Good | Good | Good |

From the results of Table 1. it is clearly seen that in the nonwoven fabric for printing prepared in accordance with the present invention, even if an ordinary, low-priced offset printing oil ink is used for printing,. the ink-fixing ability is so good that there is no probability of set-off of the ink, high print quality and good printing speed can be guaranteed and no trouble resulting from the static electricity occur. On the other hand, though good results can be seen in Comparative Example 5, an extremely expensive special ink was used therefor, thus the printing cost becomes very high in this case.

Example 5

2 parts by weight of isopropyl alcohol, 2 parts by weight of an epoxy-base cross-linking agent (A-52, produced by MITSHUBISHI GAS CHEMICAL CO., INC.) and 2 parts by weight of water were uniformly mixed together. Then, to the mixture were further added 80 parts by weight of an acrylic resin (SAIBINOL X-590-357E-4, produced by SAIDEN CHEMICAL CO., LTD.) and 14 parts by weight of water. The resultant mixture was uniformly mixed together so as to prepare an acrylic resin composition (resin solid content: 32%) for a barrier layer. Subsequently, the acrylic resin composition was coated twice on both sides of the same polyethylene filament nonwoven fabric (Weight: 50 g/m$^2$, LUXER H2050XW, ASAHI CHEMICAL CO., LTD.) as used in Example 1 with an air knife coater so that the dry weight thereof became 10 g/m$^2$ respectively, then was dried at 80° C. for 1 minute for cross-linking, so as to form a barrier layer.

Thereafter, a synthetic rubbers composition having the same blending contents as of the ink-setting layer resin composition in Example 1 was prepared. Then, the resin composition was coated on the barrier layer with a bar coater around which was wound a wire of 0.5 mm diameter so that the dry weight became 10 g/m², and was dried with warm air at 100° C., so as to form a top layer. In such a manner, a nonwoven fabric for printing both sides of which were laminated with the barrier layer and the top layer was obtained.

Example 6

A nonwoven fabric for printing both sides of which were respectively laminated with a barrier layer and a top layer was obtained in the same manner as described in Example 5 except that the blending contents of the resin composition for the barrier layer was changed as described below (resin solid content: 36%), and the blending contents of the resin composition for the top layer was changed to that of the top layer in Example 2.

The above-mentioned blending contents of the resin composition for the barrier layer were as follows:

| | |
|---|---|
| SAIBINOL X-590-357E-4 | 80 parts |
| K-1020 (Oxazoline crosslinking agent, produced by NIPPON SHOKUBAI KAGAKU KOGYO CO., LTD.) | 10 parts |
| CAT-A (cross-linking agent, produced by NIPPON SHOKUBAI KAGAKU KOGYO CO., LTD.) | 5 parts |
| Water | 5 parts |

Example 7

A nonwoven fabric for printing both sides of which were respectively laminated with a barrier layer and a top layer was obtained in the same manner as described in Example 5 except that the blending contents of the resin composition for the barrier layer is changed as described below (resin solid content: 32.5%).

| | |
|---|---|
| SAIBINOL X-590-357E-4, | 80 parts |
| AC-7 (zirconium ammonium carbonate, produced by DAIICHI KIGENSO KAGAKU KOGYO CO., LTD.) | 4 parts |
| Water | 16 parts |

Example 8

Another nonwoven fabric for printing both sides of which were respectively laminated with a barrier layer and a top layer was obtained in the same manner as in Example 5 except that the blending contents of the resin composition for the barrier layer is changed as described below (resin solid content: 33.8%), and the blending contents of the resin composition for the top layer is changed to that of top layer in Example 2.

| | |
|---|---|
| SAIBINOL X-590-357E-4, | 80 parts |
| BAYCOAT (zirconium ammonium carbonate, produced by NIPPON LIGHT METAL CO., LTD.) | 4 parts |
| Water | 16 parts |

Example 9

A synthetic rubbers composition was obtained by uniformly mixing 100 parts by weight of an aqueous mixture which was prepared from the following ingredients:

| | |
|---|---|
| Dispersant mainly containing sodium polyacrylate homopolymer | 0.2 parts |

-continued

| | |
|---|---|
| (ARONDISPEX T-40, produced by TOA GOSEI CHEMICAL INDUSTRY CO., LTD.), | |
| Filler consisting of kaolin clay, calcium carbonate and titanium dioxide | 47.6 parts |
| Synthetic rubber (CROSSLENE 2M-45A, produced by TAKEDA CHEMICAL INDUSTRIES LTD.) and casein | 16.0 parts |
| Epoxy-base cross-linking agent (A-521, produced by MITSHUBISHI GAS CHEMICAL CO., INC. | 1.2 parts |
| Isopropyl alcohol | 1.2 parts |
| Additives consisting of a catalyst, defoaming agent, softening agent, ammonia water and antiseptic | 0.9 parts |
| Water | 32.9 parts |

Then, the obtained synthetic rubber composition was coated twice on both sides of a polyethylene long-stock nonwoven fabric (LUXER H2050XW) with an air knife coater so that the dry weight became 10 g/m², then was dried at 80° C. for 1 minute for cross-linking, thus obtaining a nonwoven fabric having a single-layer ink-setting layer on each side thereof.

The nonwoven fabrics obtained respectively in Examples 5 to 9 were subjected to offset printing operation under the same condition as in Examples 1 to 4. to find that a good printing state can be similarly obtained in either case. Thus, with such nonwoven fabrics for printing prepared according to the present invention, even if an ordinarily used, low-priced offset printing oil ink is used for printing, there can be obtained a high-quality printing effect which is substantially equal to the art paper.

Example 10

| | |
|---|---|
| SAIBINOL X-590-357E | 80.0 parts |
| SUMITEX RESIN M-3 | 2.0 parts |
| ACX (Catalyst consisting of an organic amine hydrochloric acid salt, produced by SUMITOMO CHEMICAL CO., LTD.) | 0.2 parts |
| Water | 07.8 parts |

An acrylic resin component having the above composition was coated on both sides of a polyethylene filament nonwoven fabric (LUXER H2050XW) with an air knife coater so that the dry weight became 10g/m², then was dried with warm air so as to form a barrier layer.

Subsequently, a synthetic rubber composition for a top layer was prepared by uniformly mixing the following composition including non-calcined clay, titanium dioxide and calcined clay. Thereafter, the synthetic rubber composition was coated on the barrier layer with a bar coater around which was wound a wire of 0.5 mm diameter so that the dry weight became 10 g/m², then was dried with warm air at 100° C. for 1 minute, so as to obtain a top layer. Thus, a nonwoven fabric for printing both sides of which were respectively laminated with the barrier layer and the top layer.

| | |
|---|---|
| Non-calcined kaolin clay | 28.0 parts |
| Titanium dioxide | 8.0 parts |
| Calcined clay | 4.0 parts |
| CROSSLENE 2M-45A | 14.0 parts |
| Methylol melamine | 1.3 parts |
| ACX | 0.1 parts |
| Casein | 2.2 parts |

-continued

| | |
|---|---|
| Ammonia water | 0.4 parts |
| DELTOP SP (Antiseptic, produced by TAKEDA CHEMICAL INDUSTRIES LTD.) | 0.02 parts |
| SURFINOL 440-1 (Defoaming agent, produced by NISSHIN KAGAKU CO., LTD.) | 0.04 parts |
| Turkey red oil | 0.09 parts |
| ARON T-40 | 0.8 parts |
| Water | 40.85 parts |

When offset printing was carried out onto the nonwoven fabric thus obtained, the resultant print had good gloss and high quality equivalent to the art paper.

Example 11

A nonwoven fabric for printing both sides of which were respectively laminated with a barrier layer and a top layer was obtained in the same manner as described in Example 10 except that in the resin composition for the barrier layer in Example 10. 17 parts of non-calcined kaolin clay. 13 parts of titanium dioxide and 7 parts of calcium carbonate were incorporated as fillers, and the amount of ARON T-40 was changed into 0.2 part. When offset printing was carried out onto this nonwoven fabric, the resultant print had mat finish and a high-quality print state equivalent to the art paper, as well.

Example 12

A nonwoven fabric for printing both sides of which were respectively laminated with a barrier layer and a top layer was obtained in the same manner as described in Example 10 except that in the resin composition for the barrier layer in Example 10, 40 parts of non-calcined kaolin clay, 2 parts of titanium dioxide and 8 parts of calcium carbonate were incorporated as fillers. When offset printing was carried out onto this nonwoven fabric, the good results were similarly obtained.

Example 13

A nonwoven fabric for printing both sides of which were respectively laminated with a barrier layer and a top layer was obtained in the same manner as described in Example 10 except that in the resin composition for the barrier layer in Example 10, 31 parts of non-calcined kaolin clay. 5 parts of titanium dioxide and 4 parts of calcium carbonate were incorporated as fillers, and the amount of ARON T-40 was changed into 0.2 part. This nonwoven fabric was proved to be a suitable printing medium for offset printing.

Example 14

Without providing a barrier layer, a sole ink-setting layer was formed by coating the same resin composition for the top layer as in Example 10 on each side of a polyethylene filament nonwoven fabric (LUXER H2050XW) with a bar coater around which a wire of 0.5 mm diameter so that the dry weight became 20 g/m$^2$, then were dried at 80° C. for 1 minute. Thus, a nonwoven fabric for printing both sides of which were provided with the single ink-setting layer was obtained. When offset printing was carried out onto the nonwoven fabric, the resultant print had good gloss, and the print state was as good as that of art paper.

Comparative Example 6

A nonwoven fabric for printing both sides of which were respectively laminated with a barrier layer and a top layer was obtained in the same manner as described in Example 10 except that in the resin composition for the barrier layer in Example 10, 31 parts of non-calcined kaolin clay, 9 parts of titanium dioxide were incorporated as fillers, and the amount of ARON T-40 was changed to 0.2 part. When offset printing was carried oui onto this nonwoven fabric in the same manner as in Example 10, it took a considerable time to completely dry and set the printing ink onto the surfaces of the nonwoven fabric. Therefore, the amount of the printing ink to be absorbed onto the surfaces of the nonwoven fabric should be decreased, resulting in a poor coloring. Moreover, due to poor ink-setting property, the set-off problem was noted.

What is claimed is:

1. Nonwoven fabric for offset printing at least one side of which is provided with a barrier layer containing a resin which is cross-linked with a low-temperature cross-linking agent, the resin containing one or more resins selected from the group consisting of acrylic resins, synthetic rubbers and polyester resins, and a top layer which is formed on the barrier layer and comprises a resin composition containing 10 to 40% by weight of non-calcined clay, 1 to 15% by weight of titanium dioxide and 1 to 10% by weight of calcium carbonate or calcined clay, as fillers, said resin composition containing one or more resins selected from the group consisting of acrylic resins, synthetic rubbers and polyester resins.

2. Nonwoven fabric for offset printing at least one side of which is laminated with (i) a barrier layer which is formed by cross-linking a first resin composition below 100° C. with a low-temperature cross-linking agent, the first resin composition containing one or more resins selected from the group consisting of acrylic resins, synthetic rubbers and polyester resins, and (ii) a top layer which comprises a second resin composition containing one or more resins selected from the group consisting of acrylic resins, synthetic rubbers and polyester resins, and further containing 10 to 40% by weight of non-calcined clay, 1 to 15% by weight of titanium dioxide and 1 to 10% by weight of calcium carbonate or calcined clay, as fillers.

* * * * *